US005471971A

United States Patent [19]

Suzuki et al.

[11] Patent Number: 5,471,971

[45] Date of Patent: Dec. 5, 1995

[54] TURRET TILE AND MACHINE FOR PRODUCTION OF TURRET TILE

[75] Inventors: Yoshihiro Suzuki; Masaki Murata, both of Riverside, Calif.

[73] Assignee: Maruhachi Ceramics of America, Corona, Calif.

[21] Appl. No.: 242,867

[22] Filed: May 16, 1994

[51] Int. Cl.[6] ..... B28D 1/26

[52] U.S. Cl. ..... 125/23.01; 83/607; 83/608; 83/920; 225/97

[58] Field of Search ..... 125/23.01, 23.02, 125/24; 83/602, 607, 608, 920; 225/97

[56] References Cited

U.S. PATENT DOCUMENTS

| | | | |
|---|---|---|---|
| 3,098,476 | 7/1963 | Mayer | 125/23.01 |
| 4,030,392 | 6/1977 | Torres | 83/607 |
| 4,279,067 | 7/1981 | Jenks | 225/97 |

FOREIGN PATENT DOCUMENTS

| | | | |
|---|---|---|---|
| 2736457 | 2/1978 | Germany | 125/23.01 |
| 0258168 | 9/1926 | United Kingdom | 125/23.01 |

*Primary Examiner*—Robert A. Rose

*Attorney, Agent, or Firm*—Harris, Wallen, MacDermott & Tinsley

[57] ABSTRACT

An apparatus for making ceramic tiles for roofs of turrets, including interchangeable cassettes each with a frame, a base mounted thereon and having an upper surface of frustoconical shape, and cutter carriers carrying the tile cutter blades and pivotally mounted on the frame, the tile cutter blades having edges for engaging a tile on the base along a cutting line oblique to a ray of the frustoconical surface, and operable by a drive unit for moving the cutter blades toward each other and into a tile to trim the tile to the shape of an oblique frustoconical segment. A turret roofed with tiles produced by the apparatus. A roofing tile for a turret, with the tile produced by the apparatus.

4 Claims, 3 Drawing Sheets

FIG. 1
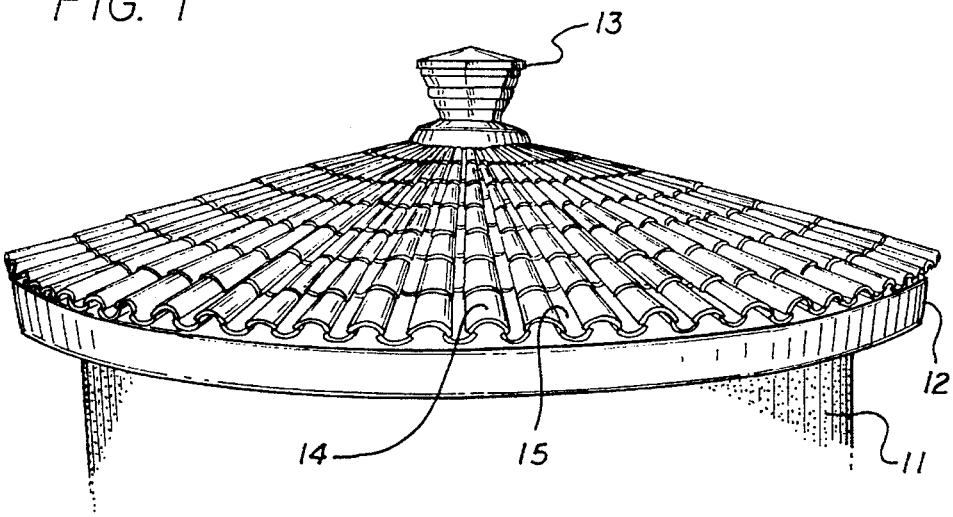
FIG. 8
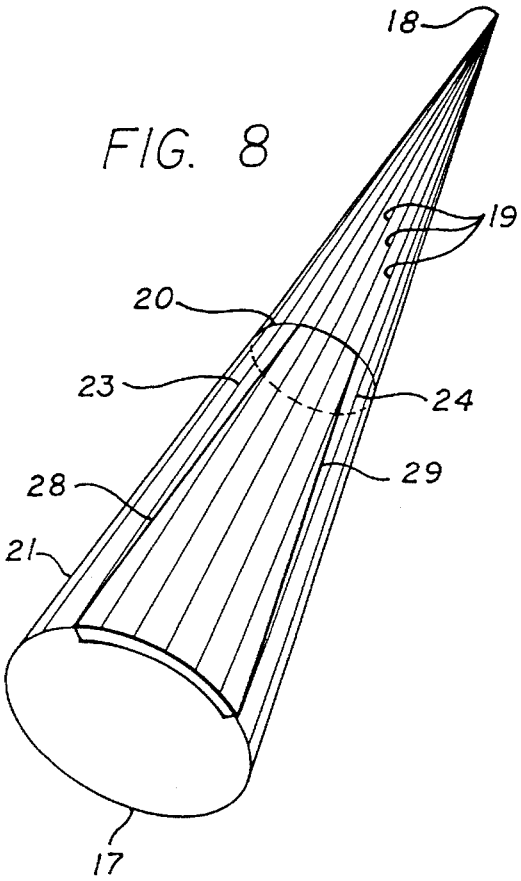
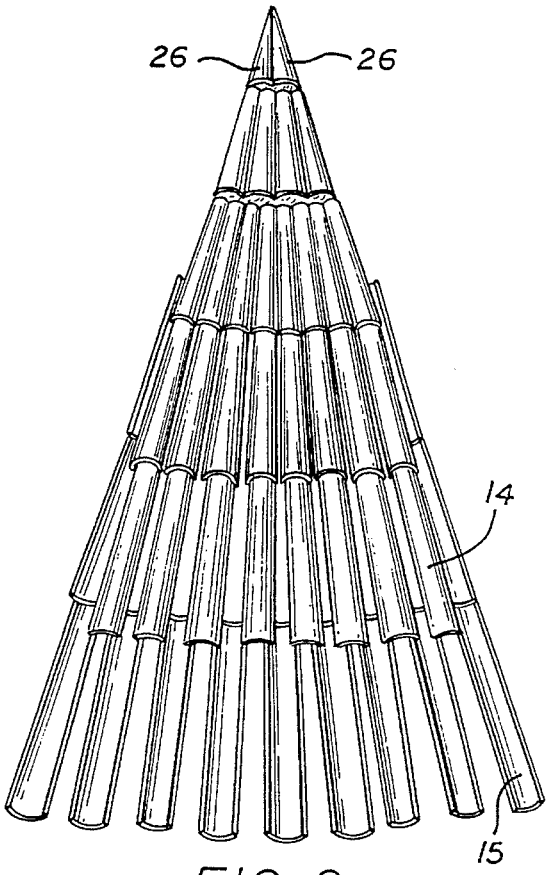
FIG. 2

FIG. 3
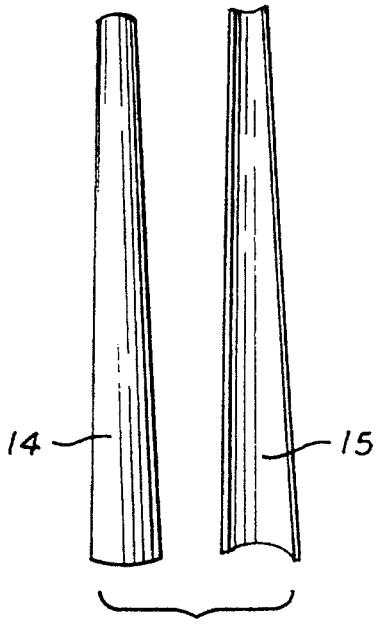
FIG. 4
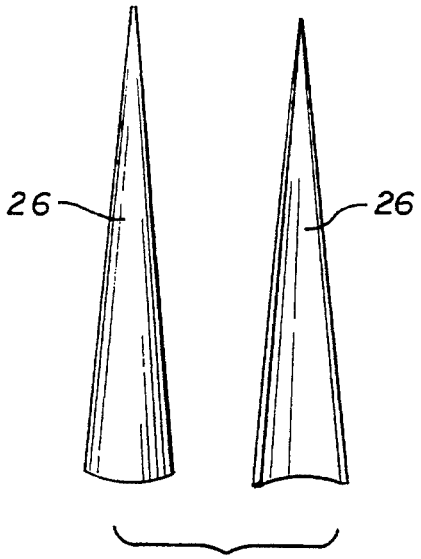
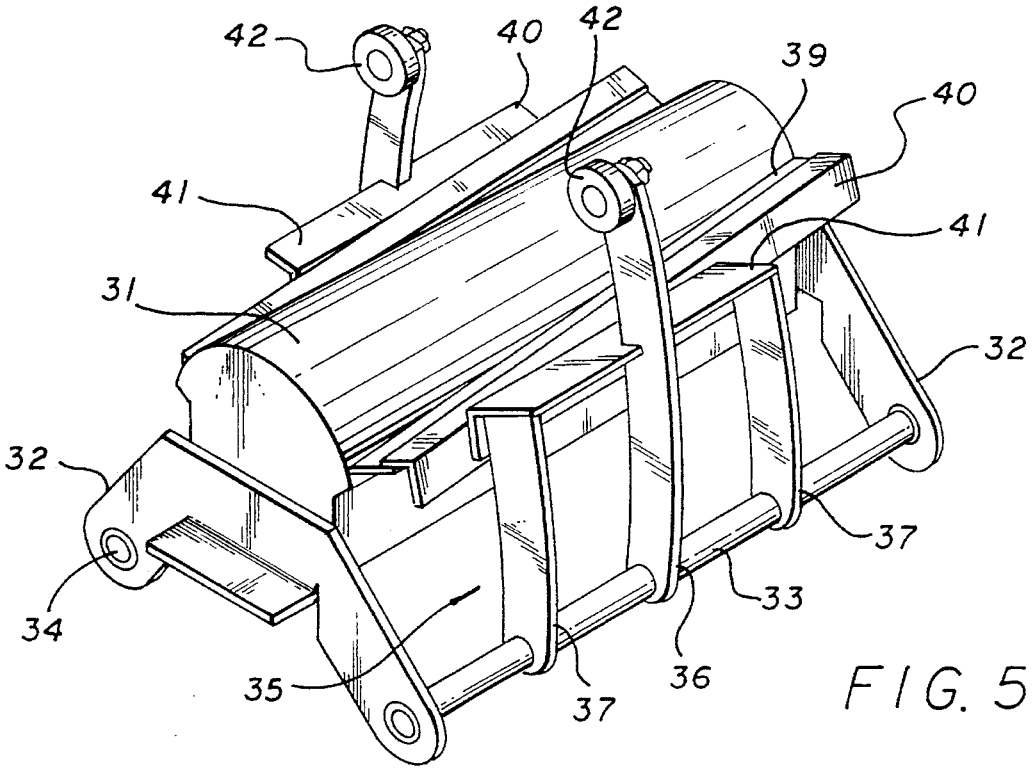
FIG. 5

TURRET TILE AND MACHINE FOR PRODUCTION OF TURRET TILE

BACKGROUND OF THE INVENTION

This invention relates to roofing tiles, typically the clay mission tile widely used for many years in the southwestern section of the United States. Initially a rectangular sheet of clay was formed over the thigh of the workman to produce a tile having the general shape of a frustoconical segment of a conical surface. The tiles were laid on a roof in an over-and-under pattern, with the over tile normally having a smaller radius of curvature than the under tile. More recently, tiles have been made by machinery resulting in tiles of substantially uniform thickness and a more regular frustoconical shape, with the same tile being used both over and under. These tiles are sometimes referred to as tapered mission tiles.

Tiles of this type are widely used today on flat roof surfaces. However, many buildings are constructed with turrets either decorative or functional, and the conventional tapered tile cannot be utilized directly, but rather has to be trimmed by hand to a different shape. The hand cutting and fitting of the tiles for a roof of a turret is an expensive and time consuming operation and can result in rather unattractive finished roofs unless the hand cutting and fitting is carefully accomplished.

Accordingly, it is an object of the present invention to provide a new and improved apparatus for making ceramic tiles for roofs of turrets. A further object is to provide a new and improved turret roofing tile and a turret roofed with tiles. Other objects, advantages, features and results will more fully appear in the course of the following description.

SUMMARY OF THE INVENTION

An apparatus for making ceramic tiles for roofs of turrets, including interchangeable cassettes, each having a frame, a base mounted on the frame and having an upper surface of frustoconical shape, cutter carriers, with a cutter carrier pivotally mounted on the frame on each side of the base, and a tile cutter blade mounted on each of the cutter carriers, each of the blades having an edge for engaging a tile positioned on the base along a cutting line oblique to a ray of the frustoconical surface, each of the cutter carriers further including an actuator arm for pivoting the cutter carrier, for operation by a drive unit for engaging the actuator arms to move the cutter blades toward each other and into a tile on the base to trim the tile to the shape of an oblique frustoconical segment.

A turret roofed with tiles produced by forming the tiles in over-and-under pairs as frustoconical segments and cutting the segment on each side with a linear blade in a tile cutting apparatus, with each tile cut along a line oblique to a ray of the frustoconical surface of the segment.

A roofing tile for a turret with the tile produced by forming as a frustoconical segment, and then cutting the segment on each side with a linear cutting blade in a tile cutting apparatus, with each cut along a line oblique to a ray of the frustoconical surface of the segment.

BRIEF DESCRIPTION OF THE DRAWINGS

FIG. 1 is a partial side view of a turret of a building roofed with tiles incorporating the presently preferred embodiment of the invention;

FIG. 2 is a top view of a layout of a portion of the tiles for the roof of FIG. 1;

FIG. 3 is a plan view showing a pair of tiles used for the roof of FIG. 1;

FIG. 4 is a plan view of a pair of tiles used at the center of a roof such as that of FIG. 1 or FIG. 2;

FIG. 5 is a perspective view of a cutter carrier of an apparatus for producing tiles of the type shown in FIGS. 1–4;

FIG. 8 is a perspective drawing illustrating the oblique frustoconical segment form of the tile.

DESCRIPTION OF THE PREFERRED EMBODIMENT

Figure 6:
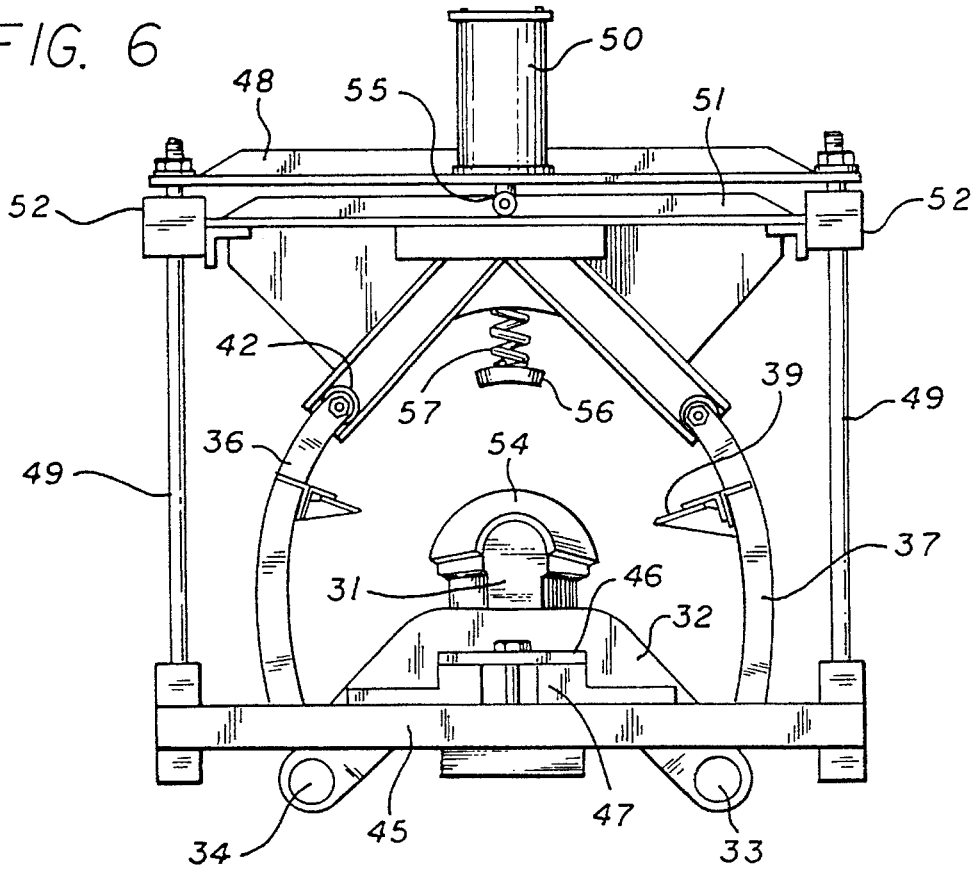
FIG. 6 is an end view showing the apparatus of FIG. 5 installed in a tile making apparatus.

In FIG. 1, a turret 11 has a conical roof 12 which in the embodiment illustrated has a finial 13 at the apex. In some installations, the finial is omitted and the tiles continue to the apex. The roof is covered with tiles, comprising upper tiles 14 and lower tiles 15 laid in the conventional manner. In earlier times, the upper tile typically had a shorter radius than the lower tile, but at the present time, more often the upper and lower tiles are identical.

In order to provide a better fit on the conical roof, the tiles are tapered so that each tile has the shape of a segment of a frustoconical surface.

Preferably the tiles of each concentric circle will be larger than the tiles of the next inner circle.

A conical surface is illustrated in FIG. 8, with a circular base 17, an apex 18, and rays 19 extending from the base circle 17 to the apex 18. Another circle 20, between the base circle 17 and the apex 18, and the base circle 17 define a frustoconical surface 21, and a segment of the frustoconical surface is defined by the rays 23, 24. This segment is the shape of a conventional tapered tile.

Prior to installing the tiles on a turret roof, the upper and lower tiles are laid out on a floor or other flat surface in the pattern of FIG. 2. In this particular illustration, pointed tiles 26 are utilized at the apex rather than a finial 13. In order for the tiles to better fit on the conical roof, each tile is shaped by hand to a modified frustoconical segment by trimming the edges along lines 28, 29 which are oblique to the rays 23, 24, respectively. With this configuration for the tiles, they can be laid out on a flat surface as in FIG. 2 and then readily transferred to the conical surface of FIG. 1 and achieve a substantially improved tile roof for the turret.

A top view and a bottom view of one of the tiles 14, 15 is shown in FIG. 3, and a top view and a bottom view of one of the pointed tiles 26 is shown in FIG. 4. The taper of the conical surface is exaggerated in FIGS. 3 and 4 to illustrate the construction. The oblique configuration of the edges of the tiles is difficult to see in FIGS. 3 and 4, but is more apparent in FIG. 5.

Figure 7:
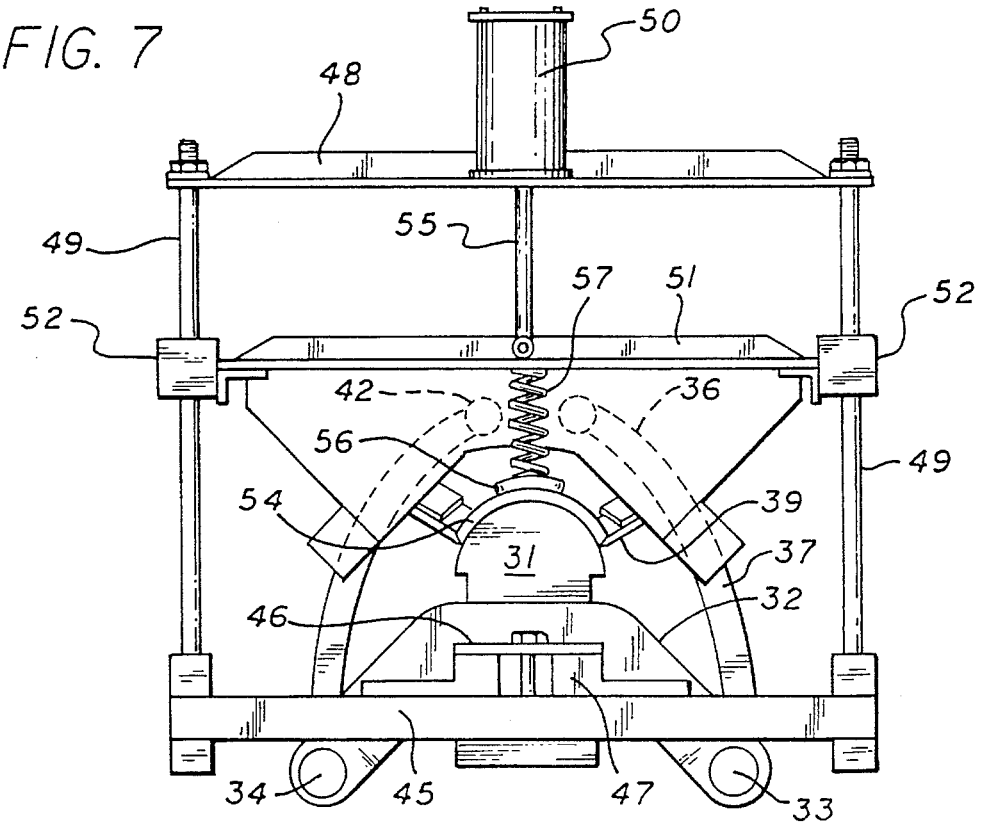
FIG. 7 is a view similar to that of FIG. 6, taken from the opposite end, showing the tile cutting operation.

An apparatus for cutting the frustoconical segment of the tapered tile to the desired shape with edges oblique to the rays is illustrated in FIGS. 5–7. This apparatus is sometimes referred to as a cassette. A base 31 is carried in a cassette frame having end plates 32. Rods 33, 34 are mounted parallel to the base in the end plates and pivot relative to the frame.

A cutter carrier 35 is mounted on the rod 33 and a similar cutter carrier is mounted on the rod 34. An actuator arm 36 and two blade arms 37 are fixed to the rod 33. A tile cutter blade 39 is detachably mounted on a first angle plate 40 which in turn is mounted on a second angle plate 41 carried on the arms 36, 37. A roller 42 is mounted at the upper end of the actuator arm 36.

The upper surface of the base 31 has the shape of a frustoconical segment, with the smaller radius at the upper right end as viewed in FIG. 5.

The frame 32 of the cassette typically is supported in a rectangular mounting frame 45, by bolting flanges 46 of the cassette frame 32 to brackets 47 of the mounting frame 45. A first transverse member 48 is positioned above the apparatus on vertical guide rods 49, with a drive unit 50 supported on the transverse member 48. A second transverse member 51 is carried on blocks 52 which slide on the vertical rods 49. The drive unit has a drive rod 55 which moves out of and into the drive unit when the unit is actuated. The outer end of the drive rod 55 is connected to the transverse member 51. Preferably, a pressure plate 56 is positioned at the lower end of a spring 57 carried on the transverse member 51.

A plate 60 is attached to the transverse member 51 and carriers channel members 61, 62 projecting downward and outward. The roller 42 of the actuator arms 36 ride in the respective channels.

In use, a tile 54 is positioned on the base. The taper of the base and tile is somewhat exaggerated in FIG. 6 for illustrative purposes. With the tile 54 in place on the base 31, the drive unit is actuated to move the rod 55 downward. This downward motion moves the rollers 42 and arms 36 toward each other as seen in FIG. 7. This downward motion also bring the pressure plate 56 into contact with the tile 54, to hold the tile in place during the cutting operation. At the end of the downward stroke, the tile cutter blades 39 have been pushed through the tile 54 along each side, to trim the tile to the desired form of a frustoconical segment with edges oblique to the rays of the conical surface. The drive unit is then reversed to move the drive rod inward and return the machine to the position of FIG. 6. The tile is then removed from the base and dried, and is then ready for firing.

The fired tile is then ready for use on the turret roof as described above.

In the preferred embodiment of the invention, a plurality of cassettes with different sizes of base 31 is provided, typically eight for eight different sizes of turret tiles providing for eight layers of eight different size tiles on a conical roof.

Turret tiles usually are made to order and the set of differently sized cassettes permits rapid production of an order. After the desired quantity of tiles of one size is cut, one cassette is removed and another is rapidly substituted, and the desired quantity of the next size is cut. This changing of cassettes is repeated until the order is completed.

We claim:

1. An apparatus for making ceramic tiles for roofs of turrets, including in combination:

a cassette frame;

a base mounted on said frame and having an upper surface of frustoconical shape;

cutter carrier means for carrying a tile cutter blade, with a cutter carrier means pivotally mounted on said frame on each side of said base;

a tile cutter blade mounted on each of said cutter carrier means, each of said blades having an edge for engaging a tile positioned on said base along a cutting line oblique to a ray of said frustoconical surface; and each of said cutter carrier means further including an actuator arm for pivoting said cutter carrier means to move said cutter blades toward each other and into a tile on said base to trim the tile to the shape of an oblique frustoconical segment.

2. An apparatus as defined in claim 1 wherein said frame has opposed ends, and each of said cutter carrier means includes a rod pivotally mounted between said frame ends with said actuator arm centrally mounted on said rod, spaced blade arms mounted on said rod, and a blade bracket mounted on said actuator and blade arms, with said blade carried on said blade bracket.

3. A machine as defined in claim 2 wherein each of said actuator arms has a roller at its free end, and including drive means with spaced guides, a drive unit mounted on said spaced guides above said base, and a transverse member carried on said guides and coupled to said drive unit for moving said transverse bar downward into engagement with said actuator arm rollers.

4. A machine as defined in claim 3 wherein said transverse member includes a transverse bar and a pair of channel members projecting downward and outward from said transverse bar for receiving said rollers.

* * * * *